United States Patent [19]

Rees

[11] 4,314,506

[45] Feb. 9, 1982

[54] PRINTING MACHINE DOCTOR BLADE ADJUSTMENT APPARATUS

[75] Inventor: Werner Rees, Augsburg, Fed. Rep. of Germany

[73] Assignee: M.A.N.-Roland Druckmaschinen Aktiengesellschaft, Offenbach, Fed. Rep. of Germany

[21] Appl. No.: 185,390

[22] Filed: Sep. 9, 1980

[51] Int. Cl.[3] ..... B41F 31/04; B41F 33/00; B41F 31/06; B41L 27/06

[52] U.S. Cl. ..... 101/365; 101/363

[58] Field of Search ..... 101/365, 350, 363, 207, 101/208, 210; 118/261

[56] References Cited

U.S. PATENT DOCUMENTS

| | | | |
|---|---|---|---|
| 3,057,294 | 10/1962 | Jameson | 101/365 |
| 3,792,659 | 2/1974 | Albrecht | 101/365 |
| 3,921,525 | 11/1975 | D'Amato et al. | 101/365 |
| 4,213,390 | 7/1980 | Liebert et al. | 101/365 |

FOREIGN PATENT DOCUMENTS

| | | | |
|---|---|---|---|
| 7730668 | 1/1978 | Fed. Rep. of Germany . | |
| 2756510 | 6/1978 | Fed. Rep. of Germany | 101/365 |

*Primary Examiner*—J. Reed Fisher

*Attorney, Agent, or Firm*—Frishauf, Holtz, Goodman & Woodward

[57] ABSTRACT

To provide an accurate output indication of the actual position of a doctor blade, as distinguished from a commanded position, in which the commanded position is determined by a positioning pin (15) in engagement with a doctor blade which, in turn, is moved into a predetermined position by an actuating pin (10) in end-face engagement therewith, the actuating pin (10) is formed with a through-bore in which a feeler pin is located which is spring-loaded to be pushed at all times into engagement with the positioning pin (15) even though the actuating pin (14) may have withdrawn to a position which is not followed by the positioning pin (15) leaving a gap between the end of the positioning pin (15) and the actuating pin (10). The actual position of the feeler pin (14) can be indicated on a scale by transmission of motion by a double-arm lever which, preferably, has unequal arm length to amplify positional changes of the feeler pin, and, if desired, additionally by coupling to an electrical position transducer. Preferably, the spring loading on the feeler pin is effected by a spring acting, for example through the electrical transducer, against the longer arm of the double-armed lever.

8 Claims, 1 Drawing Figure

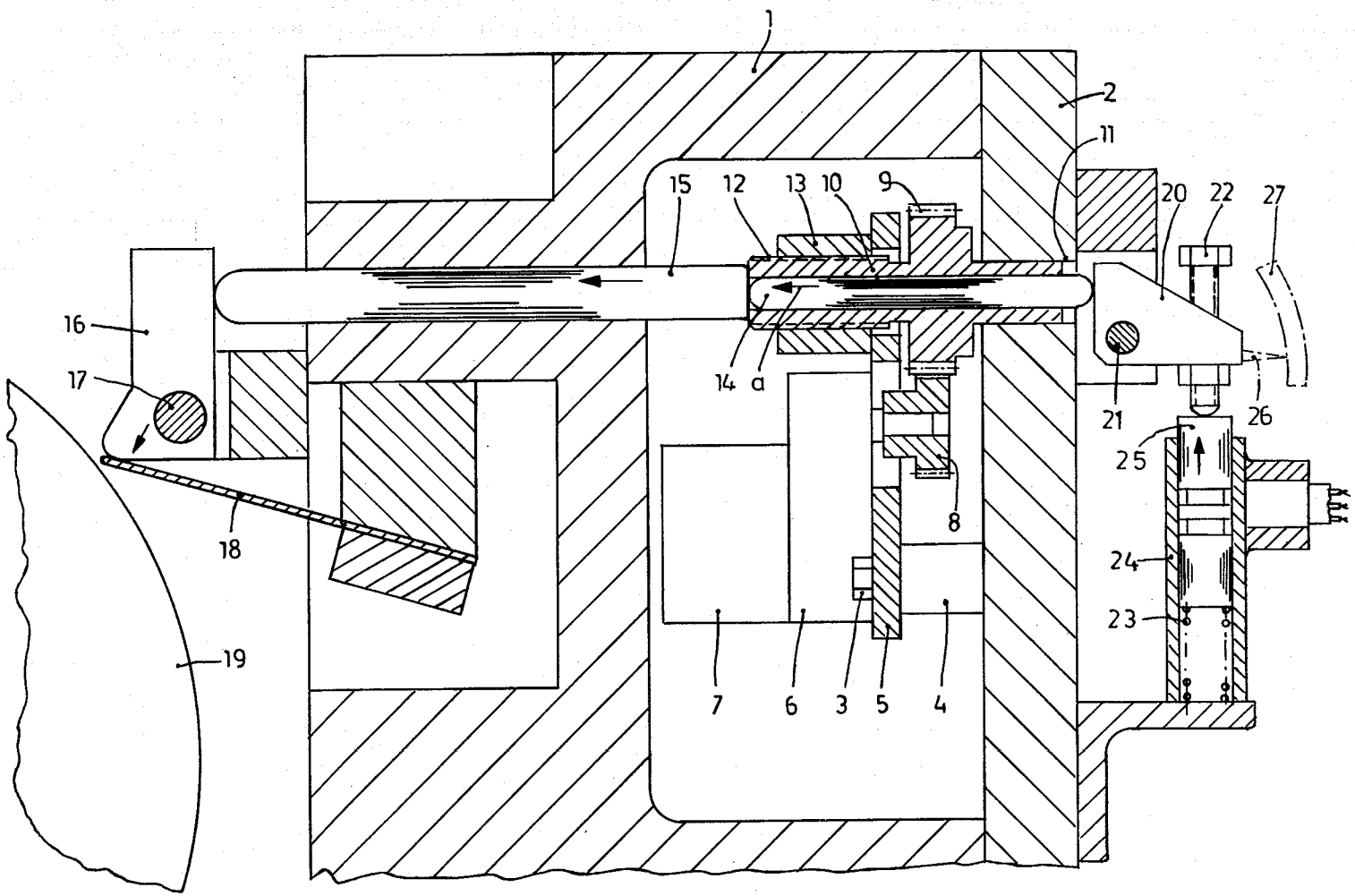
1
2
3
4
5
6
7
8
9
10
11
12
13
14
a
15
16
17
18
19
20
21
22
23
24
25
26
27

PRINTING MACHINE DOCTOR BLADE ADJUSTMENT APPARATUS

The present invention relates to printing machines, and more particularly to adjustment mechanisms for doctor blades to control the ink on an ink supply roller of a printing machine, and especially to a doctor blade which has a plurality of adjustment elements thereon along the length of the doctor blade, that is, positioned across the width of the machine.

BACKGROUND AND PRIOR ART

Doctor blades extending over a considerable length, and cooperating with ink rollers of substantial length, require adjustment along their length to provide for selective engagement of the doctor blade across the inking cylinder. One such adjustment arrangement is shown, for example, in German Utility Model DE-GM No. 77 30 668. In this arrangement, a plurality of ink doctor blade adjustment pins are provided, each supplied with an outer thread which is screwed into a tapped bore formed on a fixed doctor blade support frame. Upon rotation of the respective adjustment pins, the axial position of the pins will be changed and an adjusting movement is transferred to the doctor blade itself. To permit replacement of the doctor blade, an indication of the adjustment position of each pin is provided, for example by providing at the end of the pin an indicator scale which cooperates with a reference marker.

The subject matter to be printed may require that the doctor blade adjustment pins so adjust the doctor blade that in some locations it is very close to the inking rollers whereas, at immediately adjacent adjustment positions, the maximum possible nip or gap between the doctor blade and the ink cylinder is provided. In such arrangements, the flexibility of the doctor blade may be insufficient to completely follow the controlled adjustment, since it cannot be bent in accordance with the adjustment positions which are commanded. Play will thus arise between the doctor blade adjustment pins adjacent the pin or pins which are extended to their maximum position—that is, where the smallest gap is to occur—so that the pins adjacent this smallest gap will not transfer adjustment forces on the doctor blade itself. The position of the pins then does not correspond to the actual position of the doctor blade in these ranges, the doctor blade forming what might be termed a bridge across the pins immediately adjacent the adjustment pin commanding the smallest gap or nip. Scales attached to these pins adjacent the smallest-gap pin thus will indicate an incorrect adjustment position.

It has been proposed to provide electrically controlled positioning apparatus and indicators which are to control the position and indicate the position of the respective doctor blade adjustment pins—see German Disclosure Document DE-OS No. 21 64 351. The indications derived from electrical indicators coupled to pins adjacent a pin commanding a minimum gap or nip likewise will be erroneous.

THE INVENTION

It is an object to so construct indicating apparatus that the actual bend-through or engagement gap or nip of a doctor blade on an associated printing cylinder will be indicated.

Briefly, a measuring pin is provided, in engagement with a pin bearing on the adjustment pin, which measuring pin is spring-loaded to sense the actual position of the pin. This spring loading of the measuring pin can be obtained, for example, by forming a bore in a motion transfer element which controls the desired position of the doctor blade. Due to the stiffness of the doctor blade, however, it may not actually occupy this desired position, but rather a position of a somewhat narrower axial gap adjacent one where a minimum gap has been commanded. The spring loaded pin will then press the adjustment pin against the doctor blade beyond the commanded position and, being coupled to an indicator, will then indicate the actual position of the doctor blade, overcoming any play which might have occurred between the adjustment pin and the positioning mechanism.

The arrangement has the advantage that an external indication of the actual position of the doctor blade with respect to a cylinder can be determined, indicated, remotely indicated, or converted to an electrical signal to control appropriate further adjustment, or alert supervisory personnel.

DRAWINGS

The single FIGURE is a highly schematic transverse cross-sectional view through a doctor blade adjustment mechanism, illustrating the sensing and indicating apparatus to indicate the actual position of the doctor blade independently of a controlled position.

A frame or housing 1 is closed off at the back by a support plate 2. A support bracket 5 is secured to the support plate or carrier plate 2 by screws and spacers 4. The support bracket 5 supports an electric motor 7 coupled to a step-down transmission 6. A pinion 8 is secured to the output shaft of the transmission 6, meshing with a gear 9 coupled to a doctor blade adjustment pin 10. The end of pin 10 is guided in a bore 11 of the carrier plate 2 for both rotary and axial movement of the pin. The other end of pin 10 has an external thread 12 which meshes with a corresponding inner thread of a bushing 13 secured to bracket 5.

In accordance with a feature of the invention, the adjustment pin 11 has an axial bore in which a feeler pin 14 is guided, to be freely axially movable therein. The portions of the pin 10 for the doctor blade and of the feeler pin 14, positioned within the housing or frame 1 cooperate with a transfer pin 15 which is freely slidable in the housing 1. This arrangement places the feeler pin 14 secured against contamination by ink particles or drops within the interior of the housing 1. The transfer pin 15 engages a transfer lever 16 which is pivotally mounted on the housing by a pivot 17. Lever 16 engages doctor blade 18 secured to the housing or frame 1. The doctor blade 18 can be elastically deformed by the lever 16 so that it will be spaced from a cylinder 19 of the inking system more or less.

The end of the measuring pin 14 remote from the force transfer pin 15 cooperates with one arm of a double-armed lever 20, forming an adjustment value transfer element, which lever can pivot about a shaft 21 secure to the end plate 2. The other arm of the lever 20 is in engagement with a force transfer element 22, formed as an adjustable screw, screwed into the lever 20. The adjustment screw 22 engages a measuring transducer 25 which is slidable in a sleeve 24 and pressed by a spring 23 upwardly against the adjustment screw 22. To obtain clearly visible output indications upon even small movements of the measuring pin 14, the horizontal arm of lever 20 is longer than the vertical arm in engagement with the pin 14. The output from transducer 24/25 can be an electrical output, for electrical indication, and for further connection to electrical positioning elements, such as a servo motor, for example. Additionally, a directly readable output can be obtained by attaching an indicator 26 on the horizontal arm of the lever 20 which cooperates with a scale 27.

The particular type of position transducer selected can be in accordance with design requirements, and it does not matter what type of position transducer is used. Basically, the various pins can engage either, as shown, indirectly over lever 16, or directly on the doctor blade 18; a single pin may also be used.

Change of position of the doctor blade 18 is obtained by energizing motor 7. Rotation of motor 7 will drive pinion 8 through the reduction gearing 6, which rotation is followed by a gear 9 and transferred to the ink gap positioning pin 10 which, due to its threaded engagement with the internal thread of bushing, rotates and additionally translates horizontally in the direction of the arrow a, or counter the direction of the arrow, respectively, depending on the direction of rotation. The translatory, shifting movement is transferred to the positioning pin 15 and then to the positioning lever 16 and hence on the doctor blade 18. For example, movement of the pin 10 in the direction of the arrow a will press the blade 18 downwardly, thus decreasing the width of the gap between the doctor blade 18 and the cylinder or roller 19. Due to the pressure of spring 23, the transducer 24/25 will accurately transfer this adjustment movement from the lever 20 and pin 14 to an electrical output and/or a visual output by indicator 26 on scale 27.

The situation may arise that both ink gap pins 10 adjacent the particular ink gap pin under consideration have been set for the smallest possible gap width between the doctor blade 18 and the roller or cylinder 19. If, then, the ink position pin 10 is set for the widest ink gap between the doctor blade 18 and the roller or cylinder 19, the pin 10 will be moved to its right terminal position (with respect to the alignment of the drawing). The doctor blade 18, however, has limited elasticity in a direction transverse to the plane of the drawings and may not be able to follow this adjustment completely. A gap or play will arise between the adjustment pin 10 and the motion transfer pin 15. The adjustment pin 10, thus, will accept the position which is commanded; this will not, however, be the position which corresponds to the doctor blade 18 as such. To provide an accurate output, and possibly alert operators for corrective action, the indicator 26 on scale 27, and the transducer 24/25 will provide this accurate output since spring 23 will press the pin 14 into contact with pin 15 regardless of the position of the hollow pin 10, so that the position of the output lever 20, and hence of indicator 26/27, and transducer 24/25, will always accurately represent the actual position of the doctor blade 18 with respect to the roller or cylinder 19, even if this actual position does not, in fact, conform to the commanded position.

Various changes and modifications may be made within the scope of the inventive concept.

I claim:

1. In a printing machine, a doctor blade adjustment apparatus having a support (1);

a doctor blade (18) located on the support;

a positioning element (15) located in motion transfer relation to the doctor blade;

an actuating pin (10) engageable with the positioning element;

and means (6–9) controlling the axial position of the actuating pin (10) to, in turn, control via the positioning element the position of the doctor blade, comprising, in accordance with the invention, an actual position sensing means including an axial through-bore formed in said actuating pin (10);

a feeler pin (14) located in said bore;

spring means (23) pressing said feeler pin in axial end engagement with a face of the positioning element;

and indicating means (24, 25; 26, 27) coupled to the feeler pin for indicating the actual position of the feeler pin as pressed against the positioning element and hence of the doctor blade even in the presence of a gap between the actuating pin and the positioning element.

2. Apparatus according to claim 1, wherein the positioning element (15) comprises a positioning pin.

3. Apparatus according to claim 1, wherein the actuating pin (10) and the positioning element are located in said support for slidable movement.

4. Apparatus according to claim 2, wherein the positioning pin (15) and the actuating pin (10) are supported in said support (1) in axial alignment for slidable movement and end-face to end-face engagement.

5. Apparatus according to claim 1, further comprising a pivoted lever element (20) coupled to the feeler pin (14), one arm being in engagement with said feeler pin, and the other arm being in engagement with said spring means (23).

6. Apparatus according to claim 5, wherein the indicator means are coupled to the other arm of said lever.

7. Apparatus according to claim 6, wherein said indicator means includes an indicator pointer (26) and a fixed scale (27).

8. Apparatus according to claim 6, wherein said indicator means includes an electrical positioned transducer (24, 25) including a spring-loaded element subjected to pressure of said spring means.

* * * * *